United States Patent [19]

Burgess

[11] 4,193,575

[45] Mar. 18, 1980

[54] RADIATOR DRAIN ASSEMBLY

[75] Inventor: Carlton M. Burgess, Lockport, N.Y.

[73] Assignee: General Motors Corporation, Detroit, Mich.

[21] Appl. No.: 921,796

[22] Filed: Jul. 3, 1978

[51] Int. Cl.[2] ..... B65D 41/04

[52] U.S. Cl. ..... 251/144; 137/351; 220/375

[58] Field of Search ..... 137/316, 351; 251/144; 184/1.5; 220/375

[56] References Cited

U.S. PATENT DOCUMENTS

| | | | |
|---|---|---|---|
| 2,985,180 | 5/1961 | Grayson . | |
| 3,181,555 | 5/1965 | Jacobson . | |
| 3,223,117 | 12/1965 | Curie et al. | 251/144 X |
| 3,811,650 | 5/1974 | Dehar | 251/144 |
| 3,910,550 | 10/1975 | Nelson | 251/144 |
| 3,948,481 | 4/1976 | Pollock | 251/144 X |

*Primary Examiner*—William R. Cline
*Attorney, Agent, or Firm*—R. L. Phillips

[57] ABSTRACT

A molded plastic drain valve particularly adapted for use with automobile radiators to discharge fluid from a header tank. A drain housing or body of metal is attached by brazing to the tank wall and has an internally threaded bore therethrough terminating in a smaller drain opening encircled by a valve seat formed thereabout. A plastic valve has an external threaded portion and an axially faced sealing portion which moves to engage the valve seat of the housing. The assembly includes a unique means to prevent separation of the valve and housing including a stem which extends from the valve through the drain opening in the housing. It has a head or end portion of slightly less diameter than the drain opening and a small channel or groove located at its back side. A resilient washer member of elastomeric material is supported in the groove and its diameter is significantly larger than the drain opening. Upon valve insertion, the resilient washer folds back along the intermediate portion of the stem which is of significantly less diameter than the drain opening. When removal of the valve is attempted, the resilient washer engages the end of the housing at one side and is axially restrained by the enlarged head of the stem on the other side.

2 Claims, 6 Drawing Figures

RADIATOR DRAIN ASSEMBLY

The present invention is somewhat related in function to a previous application, Ser. No. 383,080, filed July 16, 1964, and now abandoned. In the previous application, a plastic valve member is employed with a bifurcated stem portion which is compressible radially to permit insertion but having a configured end to prevent easy removal of the valve member.

The subject drain valve assembly, like the aforementioned previous application, is also of molded plastic material and has a separation inhibiting feature. However, details of the separation inhibitor specifically claimed herein are quite different. By providing an enlarged head portion with a groove or channel therein, a resilient washer is supported in a manner so that it is caught between the end of the valve housing and the head portion when separation of the valve is attempted. The resistance to the removal of the valve is quite substantial and attempts to remove the valve required compression of the washer material over and against the enlarged head. On the contrary, insertion of the valve is smoothly accomplished with little effort. Since the stem portion connecting the main body of the valve and the enlarged head is of smaller diameter than the drain opening, the resilient washer easily folds back over the smaller diameter stem portion. Once past the edge of the drain opening, the resilient washer assumes a relaxed orientation with the outer peripheral edge extending radially outward a greater distance than the diameter of the drain opening.

Other features and advantages of the present drain cock assembly will be more apparent from a detailed reading of the following description, reference being had to the accompanying drawings in which a preferred embodiment is illustrated in various operative positions.

Figure 1:
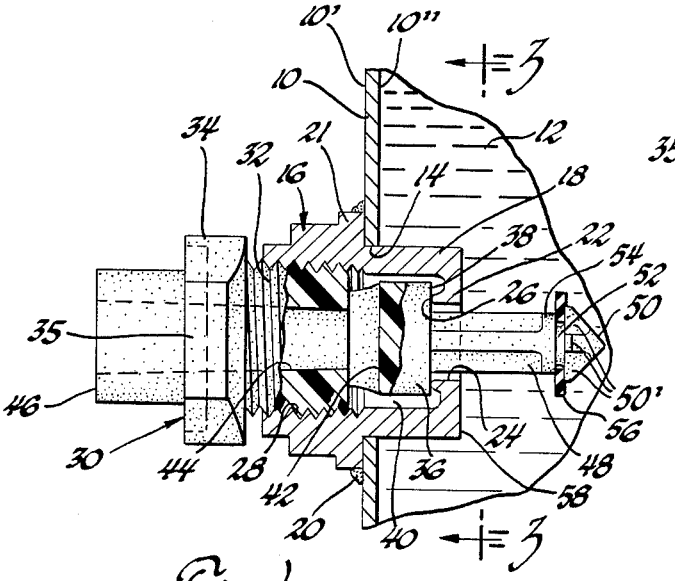
FIG. 1 is a partially sectioned elevational view of the drain cock assembly in a closed operative position.

In FIG. 1, part of the metal wall 10 of a radiator header tank is shown, having an exterior surface 10′ and an interior surface 10″ which encloses a fluid, such as radiator coolant 12. An opening 14 in the wall 10 accepts a metallic housing member 16 which is of generally cylindrical configuration and has a reduced diameter portion 18 which snugly fits through the opening 14. An annular bead 20 of brazing material holds the housing 16 to the wall 10 at an increased diameter portion 21 of housing 16. The member 16 has a partially covered end 22 through which a flow opening 24 extends. The flow opening 24 forms the drain passage for the discharge of the coolant 12 from the radiator. Opening 24 is encircled in the hollow interior of the housing 16 by an annular valve seat portion 26. Housing 16 also has a threaded interior bore 28.

A molded plastic valve member 30 is received within the threaded bore 28 of the housing 16. Member 30 has a similarly threaded cylindrical portion 32 which engages the threads of the housing 16. An exteriorly accessible handle portion 34 is provided with wings 35 for conveniently rotating the valve member 30 between closed and open positions. On the interior end of the valve member 30 and immediate the cylindrical threaded portion 32 is located a smaller diameter valve forming portion 36 having an axially facing surface 38 thereon adapted to bearingly engage the seat portion 26 of the housing 16 when in the closed position of FIG. 1. It should be noted that the smaller diameter portion 36 of valve member 30 resides in larger chamber 40 formed in the housing and the intermediate space provides part of a flow path when valve member 30 is rotated to move face 38 away from valve seat 26.

Figure 2:
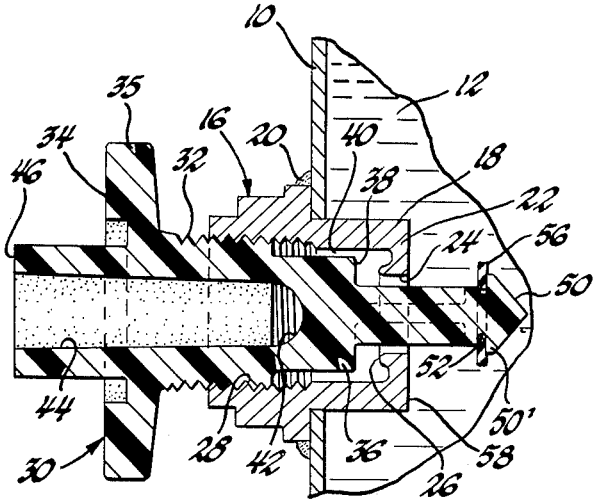
FIG. 2 is a fully sectioned view of the drain cock assembly in an open operative position.

When drainage of the fluid 12 is desired, the valve member 30 is rotated so as to cause the threaded portions 28 and 32 to move the face 38 away from the seat portion 26, as shown in FIG. 2. FIG. 2 thus represents an open position of the valve. In the open position, fluid 12 can pass through the opening 24 and through the chamber 40. From thereon, fluid passes through a radial passage 42 in the molded valve member 30 and through an intercepting and axial passage 44. Fluid exits from an open end 46 of the valve member. The open end 46 is framed by an outwardly projecting cylindrical portion which may be attached to a hose to carry the fluid to a container.

Figure 3:
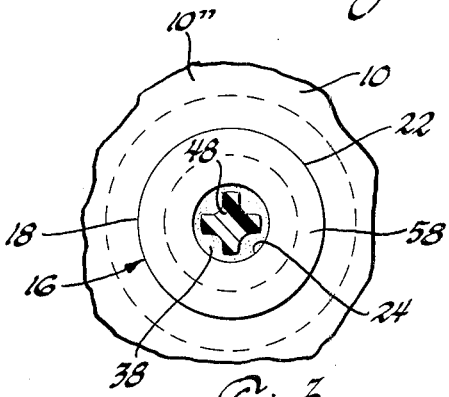
FIG. 3 is a sectioned view taken along section line 3—3 in FIG. 1 and looking in the direction of the arrows.
Figure 6:
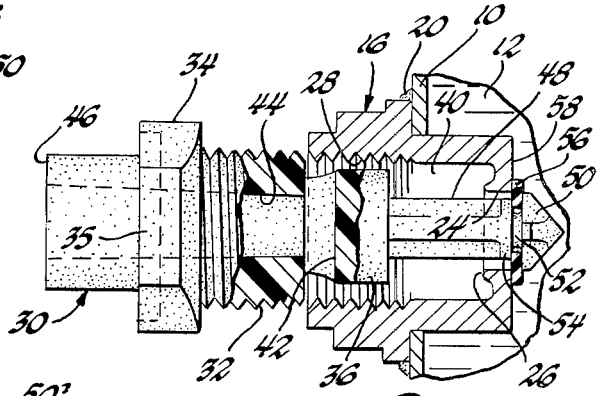
FIG. 6 is a view similar to FIG. 1 and showing the operative position of the valve member and the housing when separation of the valve member is attempted.
Figure 4:
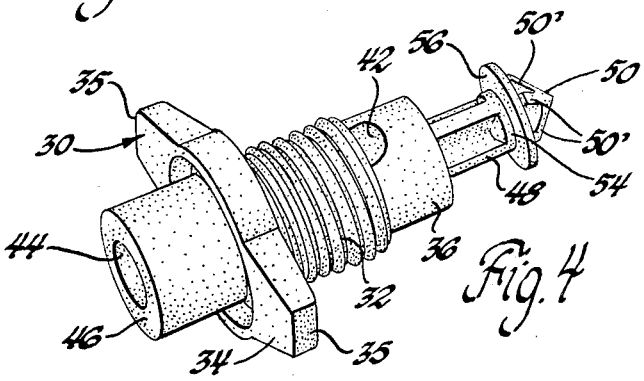
FIG. 4 is a perspective view of the molded plastic valve member shown in FIGS. 1 and 2.

To prevent loss of the valve member 30 by separation from housing 16, the present invention provides means to prevent easy removal and separation of the valve member from the housing. As best shown in FIG. 6, the valve member 30 may be unscrewed from the position shown in FIG. 2 to a position in which thread members 28 and 32 no longer engage. In this position, there would be a risk of misplacing the valve member 30 by separation from the housing. The present invention provides means including the projecting stem member 48 to prevent separation. Specifically, the stem member 48 has a diameter substantially less than the diameter of opening 24 in housing 16. The cross section of the stem member 48 is cross-shaped, as shown in FIG. 3, to facilitate flow of fluid between the stem and the opening 24. The stem 48 has an enlarged diameter head portion 50 which also has a crossed shape. Between the cross-shaped portions and behind the head portion 50 is a cylindrical portion 54 which has an annular channel or groove 52 formed adjacent thereto. Within groove 52, an annularly shaped resilient washer member 56 of elastomeric material is supported. The outer diameter of the washer 56 is substantially larger than the diameter of opening 24 in housing 16. When the valve member 30 is extracted from the housing 16 to the position shown in FIG. 6, whereas threads 28 and 32 no longer engage, one surface of the washer 56 abuts the end surface 58 of housing 16. The opposite surface of the washer 56 is backed up by the four projecting portions 50′ of the enlarged diameter head portion 50. Thus, removal of the valve member 30 from the housing 16 is quite difficult and requires considerable force to cause the outer portion of the washer member 56 to fold back over the projecting portions 50′ and be compressed between the walls of passage 24 and the portions 50′.

Figure 5:
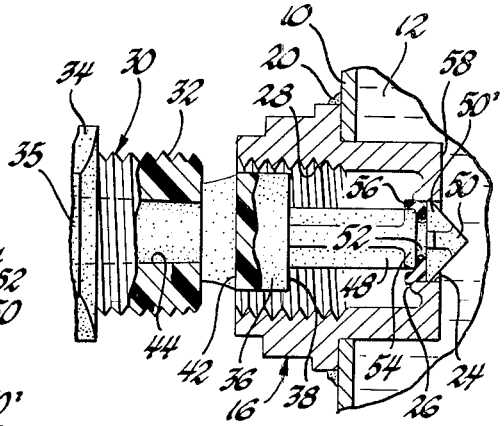
FIG. 5 is a view similar to FIG. 1 but showing the valve member during insertion within the housing which occurs when the parts are originally assembled.

In contrast to the large amount of force required to remove valve member 30 from the housing 16, the force necessary to originally seat the valve member during assembly of the drain cock is relatively minor. As shown in FIG. 5, the valve member 30 is inserted into the threaded opening 28 and the projections 50' of the enlarged head portion 50 easily slips through the opening 24 and past end surface 58. The outer portion of the resilient washer 56 easily bends or folds over the small diameter circular portion 54 of the stem 48. After the resilient washer 56 moves far enough to the right in FIG. 5 so as to be past end surface 58, the washer 56 relaxes and the outer portion thereof extends radially outward from the stem portion to the position shown in FIG. 6. Thus, a provision is made for easy insertion of the valve with retainer means without damaging the parts of the retainer. Also, the pointed configuration of the enlarged diameter head 50 makes it relatively easy to slip the resilient member 56 thereabout and into the channel 52 during fabrication of the valve.

One embodiment of the invention has been shown but other detailed modifications thereof are contemplated which would not fall outside the scope of the following claims which solely define the invention.

What is claimed is as follows:

1. In a drain closure of the type having an internally threaded support body with a drain opening therein which is adapted to be attached in the wall of a liquid container, an elongated valve member with an externally threaded portion engaged with the threaded portion of the support body and having an internal flow passage therein, an improved retention means comprising:

a stem portion integral with the valve member and configured to permit its extension through said drain opening and including an intermediate portion thereof configured in association with the drain opening to allow fluid flow between the stem and the support body;

an end of said stem portion having an enlarged head portion with a diameter providing a close fit through said drain opening and a small diameter portion inward therefrom having a circumferential groove adjacent to the head portion, an elastomeric washer member seated in said groove and having an outer diameter larger than the diameter of the drain opening, the diameter of said inward stem portion adjacent said groove and washer therein providing clearance to accommodate the thickness of said washer without substantial compression as it is folded back over the stem during insertion of the enlarged head through the drain opening, the diameter of the enlarged head being slightly smaller than said drain passage but sufficient to prevent withdrawal of the elastomeric washer without substantial compression of the washer material against the enlarged head portion thereby preventing easy and inadvertent removal of the valve without a significant removal force.

2. In a drain closure of the type having an integrally threaded support body having a drain opening therein which is adapted to be attached in the wall of a liquid container, an elongated valve member with an externally threaded portion engaged with the threaded portion of the support body and having an internal flow passage therethrough, an improved retention means comprising: a stem portion integral with the valve member and configured to permit its extension through said drain opening and including;

an intermediate portion thereof having at least one axially extending channel partially therein to allow flow of fluid between the stem and the support body, an end of said stem portion having an enlarged head portion and an inward located small diameter portion with a circumferential groove formed adjacent and inward from the head portion, an elastomeric washer seated in said groove and having an outer diameter larger than the diameter of the drain opening, the diameter of said inwardly located stem portion adjacent said washer providing clearance with the drain opening to accommodate the thickness of said washer without substantial compression thereof as it is folded back over the stem during insertion of the head portion through the drain opening, the enlarged head having circumferentially spaced and outwardly projecting legs with an effective diameter slightly smaller than said drain opening but sufficient to prevent withdrawal of the washer without considerable localized compression of the washer material between the support body and the legs, thereby preventing easy and inadvertent removal of the valve and without a substantial removal force.

* * * * *